United States Patent [19]

Hannigan

[11] 3,999,221

[45] Dec. 28, 1976

[54] DISPOSABLE BIB

[75] Inventor: Linda Hannigan, River Grove, Ill.

[73] Assignee: Lawrence Peska Associates, Inc., New York, N.Y. ; a part interest

[22] Filed: Oct. 1, 1975

[21] Appl. No.: 618,640

[52] U.S. Cl. ..... 2/49 R

[51] Int. Cl.[2] ..... A41B 13/10

[58] Field of Search ..... 2/49 R

[56] References Cited

UNITED STATES PATENTS

| | | | |
|---|---|---|---|
| 3,452,363 | 7/1969 | Schultz | 2/49 R |
| 3,793,644 | 2/1974 | Kellner | 2/49 R |
| D233,275 | 10/1974 | Goldman | 2/49 R |

FOREIGN PATENTS OR APPLICATIONS

| | | | |
|---|---|---|---|
| 21,758 | 5/1947 | Finland | 2/49 R |
| 110,263 | 4/1944 | Sweden | 2/49 R |

*Primary Examiner*—Alfred R. Guest

*Attorney, Agent, or Firm*—Jack D. Slobod

[57] ABSTRACT

A disposable bib of one piece construction having a pair of elongated tie strips formed from the material to be removed to create a neck opening. The neck opening has an arcuate generally circular bottom portion and each of the tie strips, which are of a length greater than the diameter of the neck opening, are coiled in the neck opening with a side of each strip in contact with the arcuate bottom portion.

2 Claims, 2 Drawing Figures

DISPOSABLE BIB

FIELD OF THE INVENTION

The present invention relates generally to disposable bibs which are die cut or perforated out of a sheet of material. In its particular aspects, the present invention relates to a disposable bib in which elongated tie strips are formed from the material removed to create a neck opening.

BACKGROUND OF THE INVENTION

Disposable bibs have been available during the last few years for use with infants and for restaurant use. Typically such bibs are made from non-woven toweling material or from plastic sheet. Illustrative of present disposable bibs are U.S. Pat. No. 3,329,969 to Farber et al, U.S. Pat. No. 3,332,547 to Rowe et al, and U.S. Pat. No. 3,452,363 to Schultz. It is believed that such disposable bibs would be used more than they presently are if they were more adaptable to different size necks. For example, in my judgement, because of the nature in which the bib is formed by Schultz in the aforementioned U.S. Pat. No. 3,452,363, the tie strips therefor are of inadequate length to accommodate an adult for restaurant use.

OBJECTS OF THE INVENTION

It is a primary object of the present invention to provide a disposable bib of one piece construction which will accommodate different size necks.

It is a further object of the present invention to provide a disposable bib of one piece construction in which a minimum amount of material is wasted.

SUMMARY OF THE INVENTION

Briefly, the aforementioned and other objects are satisfied by providing a one piece bib, adapted to be cut or perforated from a sheet, with elongated tie strips which are longer than heretofore feasible so that the bib may accommodate different size necks.

In order that a minimum amount of sheet material is used the tie strips are formed from the sheet material which would ordinarily be removed to form a neck opening in the bib. The tie strips are coiled in the neck opening with a side of each strip making substantial contact with an arcuate lower portion of the neck opening. This coiling allows each tie strip to be of a length greater than the diameter of the neck opening.

Other objects, features and advantages of the present invention will become apparent upon a perusal of the following detailed description of one embodiment thereof when taken in conjunction with the appended drawing wherein.

DETAILED DESCRIPTION

Figure 1:
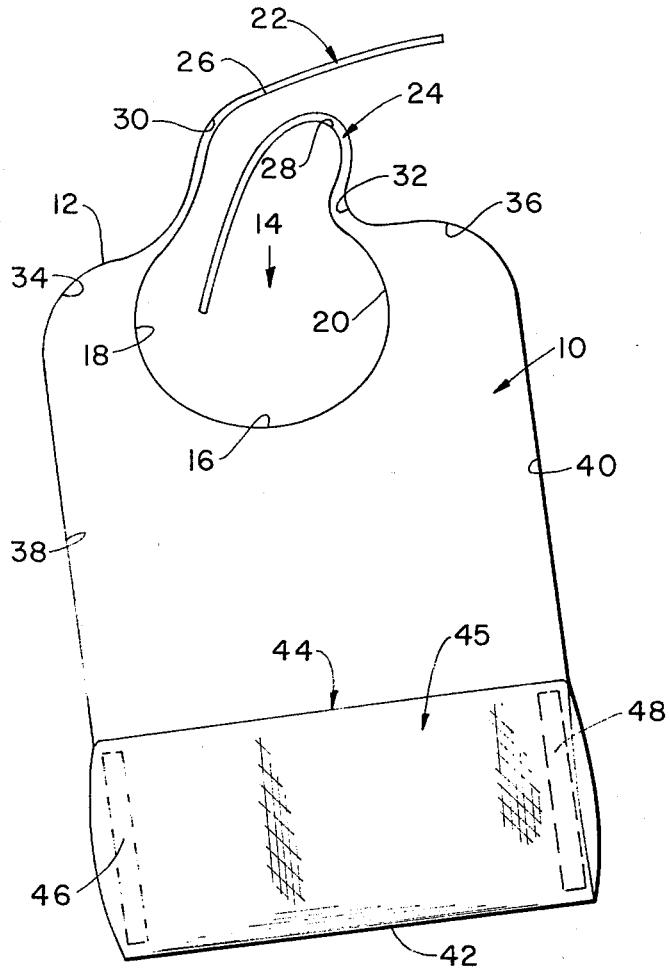
FIG. 1 is a plan view of the bib of the present invention.

Referring first to FIG. 1, the disposable bib 10 of the present invention is formed from a single sheet of suitable material such as plastic or non-woven textile or paper. Bib 10, at a top end 12 has a generally circular neck opening 14 formed therein. Neck opening 14 has the usual arcuate bottom contour 16 merging with left and right side contours 18 and 20. Also merging with left and right side contours 18 and 20 there are respectively formed left and right elongated tie strips 22 and 24 which project from and form a part of the top end 12 of sheet 10. Elongated tie strips 22 and 24 are each of a length greater than the diameter of the generally circular neck opening 14 in order that the bib 10 may accommodate various size necks, from infant to adult.

The respective inner sides 26 and 28 of left and right tie strips 22 and 24 merge with left and right neck opening sides 18 and 20. The outer sides 30 and 32 of left and right tie strips 22 and 24 merge into similar left and right S curves 34 and 36 which form rounded corners for the top end 12 of bib 10 for better fitting against the body of the wearer.

S curves 34 and 36 merge into parallel left and right straight sides 38 and 40 which lead to the bottom end 42 of bib 10. At bottom end 42 there is formed a crumb-catching pocket 44. Pocket 44 is provided by folding a flap portion 45 of bottom end 42 and securing the folded flap at the margins of sides 38 and 40 to the portion of bib 10 beneath the flap 45 with vertical left and right adhesive two sided tape strips 46 and 48. Strips 46 and 48 may alternatively be formed of a multiplicity of upstanding miniature hooks commonly referred to with the trademark Velcro.

Figure 2:
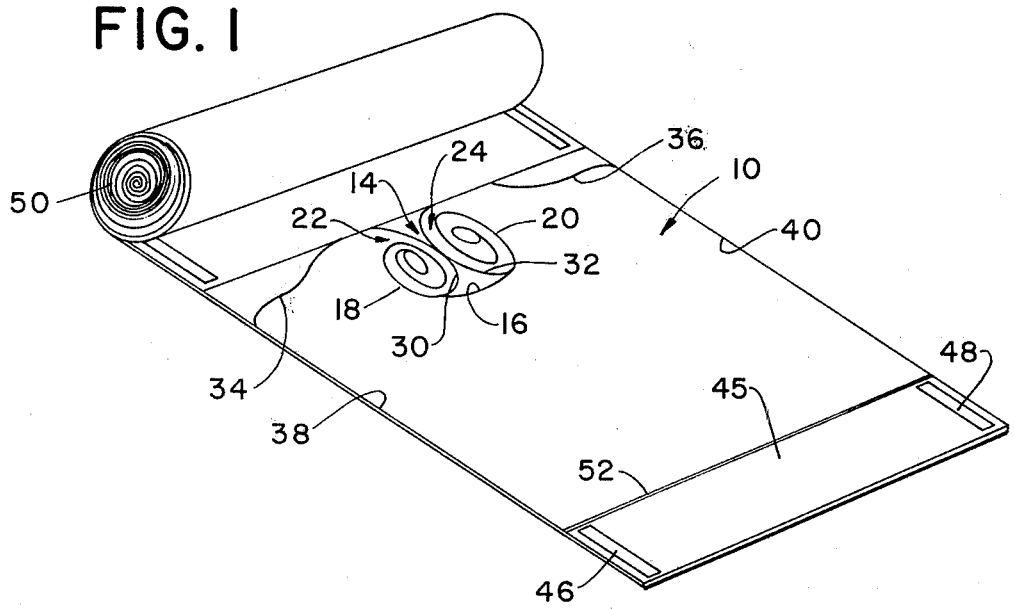
FIG. 2 is a pictorial representation of the bib of FIG. 1 illustrating the cut lines for producing the bib from a sheet.

Reference will next be made to FIG. 2 for an understanding of how the disposable bibs 10 may be successively die cut or perforated from sheet stock 50. Sheet stock 50, which is suitably provided on a roll is preferably chosen of a width that the sides of the stock form the sides 38 and 40 of bib 10.

The left and right tie strips 22 and 24 are cut from the material removed to make neck opening 14 in order that elongated ties may be formed without wasting material. To this end tie strips 22 and 24 are each cut from neck opening 14 in a coil or spiral. The left and right ties 22 and 24 are each in separate coils in the neck opening with the respective outer sides 30 and 32 of the ties being tangent to each other and each following the lower arcuate portion 16 of the neck opening for a substantial distance.

To form pocket 44, flap 45 comprises the lower end of the stamped sheet and a fold line 52 is lightly embossed in the sheet stock 50 above flap 45. At the side margins of flap 45 are deposited adhesive strips 48, which may be covered with release paper (not shown) so that a plurality of perforated bibs 10 may be supplied in the form of a perforated roll.

Having described a preferred embodiment of the present invention, it should be apparent that numerous modifications are possible within its spirit and scope. Accordingly, reference as to the scope of the invention should be made to the following claims.

What is claimed is:

1. A disposable bib of one piece construction comprising: a sheet of material of which said bib is formed; said sheet having a top end; a generally circular neck opening in said top end defined by a generally circular contour; said neck opening being formed by removing a generally circular piece of material from said neck opening; a pair of elongated tie strips; each strip being of a length greater than the diameter of said neck opening; each tie strip forming a part of said sheet and being connected integrally to the top end of the sheet on a different side of the neck opening; each of said tie strips being formed from the piece of sheet material removed from the circular neck opening, said tie strips being formed from said piece of material as side by side spiral coils which when formed are in contact with said generally circular contour and with each other.

2. The disposable bib of claim 1 wherein said sheet of material has a generally straight bottom margin and further comprising a fold line embossed in said material parallel to and spaced from said bottom margin; the portion of said sheet below said fold line comprising a foldable flap; and adhesive deposited along the side margins of said flap in order that said flap may be folded upwards and adhered to portions of said sheet material above said fold line to define an upwardly opening pocket.

* * * * *